US010161224B2

(12) United States Patent
Wilson

(10) Patent No.: US 10,161,224 B2
(45) Date of Patent: Dec. 25, 2018

(54) HOT WATER RECYCLE FOR PARAFFIN CLEANOUT

(71) Applicant: CONOCOPHILLIPS COMPANY, Houston, TX (US)

(72) Inventor: Dennis Ray Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/234,677

(22) Filed: Aug. 11, 2016

(65) Prior Publication Data

US 2017/0044871 A1 Feb. 16, 2017

Related U.S. Application Data

(60) Provisional application No. 62/203,666, filed on Aug. 11, 2015.

(51) Int. Cl.
*E21B 37/06* (2006.01)
*E21B 37/00* (2006.01)
*E21B 37/08* (2006.01)

(52) U.S. Cl.
CPC ..... *E21B 37/06* (2013.01)

(58) Field of Classification Search
CPC ..... E21B 37/00; E21B 37/06; E21B 37/08; E21B 36/006; E21B 21/063
See application file for complete search history.

(56) References Cited

U.S. PATENT DOCUMENTS

| | | | | |
|---|---|---|---|---|
| 1,358,393 | A | 11/1920 | Rathvon | |
| 2,704,979 | A | 3/1955 | Van Willigen | |
| 4,509,599 | A | 4/1985 | Chenoweth et al. | |
| 4,813,482 | A | 3/1989 | Walton | |
| 4,896,725 | A * | 1/1990 | Parker | E21B 36/00 166/267 |
| 2005/0022994 | A1 | 2/2005 | Wilson | |
| 2011/0209869 | A1 * | 9/2011 | Smith | E21B 43/16 166/260 |

OTHER PUBLICATIONS

Haitao, et al—"Thermal wax cleaning technology of the hollow rod without cutting production", 2013, Oil Drilling & Production Technology, vol. 35, Issue No. 4, pp. 117-118, includes abstract and English translation; 4 pgs.
International Search Report—PCT/US2016/046593 dated Oct. 28, 2016; 2 pgs.

* cited by examiner

*Primary Examiner* — Catherine Loikith
(74) *Attorney, Agent, or Firm* — Boulware & Valoir

(57) ABSTRACT

Paraffin deposits from downhole tubing, pumps and valves are removed by hot water and recycling the hot water to allow continual intermittent cleaning throughout the lifespan of the well. Heated water travels down the hollow rod annulus, entering the hollow rod string through ports at the bottom, temporarily heating both strings to melt and mobilized paraffin to enable intermittent pumping paraffin and debris to surface.

12 Claims, 4 Drawing Sheets

HOT WATER RECYCLE FOR PARAFFIN CLEANOUT

PRIOR RELATED APPLICATIONS

This application is a non-provisional application which claims benefit under 35 USC § 119(e) to U.S. Provisional Application Ser. No. 62/203,666 filed Aug. 11, 2015, entitled "HOT WATER RECYCLE FOR PARAFFIN CLEANOUT," which is incorporated herein in its entirety.

FEDERALLY SPONSORED RESEARCH STATEMENT

Not applicable.

FIELD OF THE DISCLOSURE

The disclosure generally relates to hydrocarbon wells and the problem of paraffin blockage and methods, apparatus and well configurations or systems for addressing same

BACKGROUND OF THE DISCLOSURE

Blockages in the flow of oil during production are common and are often due to the deposition of heavy organics from petroleum fluids. These heavy organics, such as paraffin and asphaltenes, exist in crude oil products in various quantities and forms a precipitate or crystallize into solids when temperature or pressure drops in the oil production process. These heavy solids stick to the walls of tubulars and to reservoir surfaces, resulting in blockage of flow. These solids can also pick up coal, limestone, sand or other fines, further thickening the material, and further contributing to blockage.

Heavy organics, in many instances, move from the well tubing to flow lines and to production separators, pumps, strainers and other fluid-handling equipment, creating further operational problems. In many cases, oil wells are completely shut down after being plugged by these heavy materials.

The principal difficulty in designing a program for control of paraffin is the uncertainty of the composition of the deposit. Well deposits can vary from a mushy consistency at the upper end of the deposit to hard, crystalline waxes at the bottom. The type of wax is a function of the carbon atoms in the molecule (carbon number), and the melting temperature increases with the carbon number. Generally, wax components in the carbon number range of C12 to C25 are classified as soft and those in the C25 to C50+ range as hard, and hard deposits are In pipeline deposits where temperature and pressure remain relatively constant, the wax will generally be of a uniform composition harder to remove with thermal treatments.

Wax composition and temperature are the primary factors determining where deposition will occur, but pressure can be of major importance in partially depleted reservoirs with low bottom hole temperatures. In addition to higher temperature maintaining the wax in solution, the light ends, i.e., propane, butanes and pentanes, increase the solubility of the wax in the reservoir hydrocarbons. As the reservoir pressure depletes, these condensate fractions enter the gas phase and waxes precipitate. In some shallow fields with low bottom hole temperatures, wax deposition may occur in the reservoirs, further complicating the control and removal treatments.

Current methods addressing the paraffin problem are as follows:

Mechanical Removal:

The use of wireline cutting tools and flowline scrapers is the oldest method of removing wax deposits, and costs roughly the same as thermal techniques. It is possible with some systems to perform scraping operations while the well is producing, allowing the operator to keep production levels high. However, it is important in both well bore and flowlines to schedule cleanings at frequent enough intervals.

Scraping techniques are well established, but they are not without disadvantages. Scraping can result in large chunks of scraped paraffin settling in flowlines or surface equipment causing blockage. Metal to metal contact also roughens the tubing wall thus encouraging deposition, bacterial growth, and corrosion.

Chemical Remediation and Prevention:

Chemical solvents, dispersants and wax crystal modifiers have often been used in conjunction with the mechanical and thermal techniques to enhance the effectiveness of the treatments.

Chemical solvents and dispersants may also be effective in removing deposits from wells and flowlines depending on the degree of blockage. Wax dispersants and solvents can be used in conjunction with mechanical and thermal techniques to improve efficacy in the removal of deposits. Regular batch treatments or continuous injection can keep wax deposition under control, but mechanical and thermal techniques may still be needed on a frequent basis.

Wax crystal modifiers are used to prevent or inhibit wax deposition. Where applicable, wax crystal modifiers can significantly reduce the need for remediation and lower operating costs.

However, while chemical treatments may help to manage paraffin issues in the well, chemicals do not suspend the paraffin indefinitely and can be damaging to the environment. Additionally, chemical treatments can partially dissolve or disperse paraffin, only to have it recrystallize further down the line in another area of the well. Chemical treatments are often not sufficient of themselves to address the paraffin problem.

Thermal removal: Next to scraping, removing paraffin in well bores and flow lines by melting the deposits has the longest history of continuous use in production operations. Melting the wax is usually by the injection of hot oil or hot water. This technique is simple, low cost and the results are immediate.

U.S. Pat. No. 2,704,979 for example, describes the use of nested tubes, the inner of which is connected to a pump, wherein hot oil is run down the inner tubing, out the ports, and up the annulus to melt paraffin deposits, which are then carried away with the heated medium. The flow path can also be reversed, sending hot medium down the annulus, and bring the hot medium plus melted heavies up the inner rods. Typically hot oil treatments are used that require a hot oil truck to bring hot oil to the field. Hot oil is run through the system, and produced with paraffin dissolved in oil. Problems occur as the hot oil cools and wax again congeals. If melted wax enters the formation, especially in wells less than 160° F., the congealed wax can cause permeability damage.

Although simple and at least partially effective, thermal treatments are not a panacea, particularly when insufficient amount of heated medium are provided and/or for insufficient time to thoroughly melt all heavy deposits, in particular the harder deposits with higher melting points.

When hot fluid is injected into a well, the heat of the fluids rapidly transfers to the cooler well bore equipment and waxes in the upper sections of the well. As pumping of the hot treating fluid continues the heated zone progresses down the well bore removing additional deposits. However, the treatment will not completely clean the well unless the treating fluid is hot enough and injected long enough to reach the melting point of the hard waxes at the lower end of the deposit.

Initially, only a thin layer of hard wax remains in the well when insufficient heat was applied. With continuing inadequate treatment, the thickness of the hard, crystalline wax layers increases, until eventually, flow is restricted and the heat treatments are no longer effective. This problem can be further complicated in wells with low bottom hole temperatures. The deposit can form over the producing interval and may extend into the reservoir. This can create skin damage that complicates well servicing procedures.

Hot oilers commonly draw the oil needed for hot oiling from the bottom of storage tanks nearest to the well. These tanks will usually contain higher quantities of wax due to prior hot oil treatments or wireline scraping. The tank bottoms may also contain solids such as iron sulfide, clay, sand and iron oxide. The potential for damaging the well goes up when using oil from the bottom of the tank.

There is another hidden cost in hot oiling that often is overlooked. Oil is lost during hot oiling due to its volatility. Hot oil trucks hold 60-75 barrels of oil and as much as 3-10 barrels can be lost during each hot oil job. Loss of light ends not only reduces crude volume, but also results in a higher concentration of wax components being pumped to the bottom of the well. After one considers all the risks, it may be more desirable to use hot water instead of hot oil.

Although U.S. Pat. No. 2,704,979, discussed above, states that hot water can be used in thermal removal methods, water based methods are not exemplified and no details are given. Thus, one can only assume that the same methods used for hot oil would be used for hot water, although in our experience, these are not suitable, or at least less suitable. For example, waxes are not soluble in water, and thus the methods will need to be modified to accommodate this reality.

In-situ heat generating techniques have been successful in certain situations. These are several patented processes that all basically do the same thing. They involve the careful placement of chemical solutions near the paraffin deposit that react when they come into contact with one another to generate large amounts of heat. Some of the processes also generate nitrogen that can also aid in the recovery of production. Some of the hazards associated with in-situ generating techniques are rapid pressurization, potential corrosion, and fire. Field operations should be aware of all of the associated hazards of using these techniques and they should only be performed by qualified personnel.

Paraffin removal by heating is a reasonably effective method for control of wax depositions when the limitations are recognized and treatments are designed and implemented to assure complete removal, but as with the other techniques, the limitations must be recognized, and it is easier to remove soft waxes than hard.

None of the above methods is thus completely satisfactory, and paraffin deposits continue to plague the industry. Much has been spent in research on methods for preventing or removing paraffin deposits, but no universal solution has ever been found and the paraffin problem is as insidious today as it ever was.

There remains further need in the art to develop methods of addressing the paraffin buildup in producing wells.

SUMMARY OF THE DISCLOSURE

The hot water paraffin pumping system is a hollow rod pumping system set up to use the tubing hollow rod annulus conduit to convey heated, clean, chemically treated produced water down the tubing annulus to heat the tubing and hollow rod string. The heated water travels down the hollow rod annulus, entering the hollow rod string through ports at the bottom, temporarily heating both strings to melt and mobilized paraffin to enable intermittent pumping paraffin and debris to surface.

If desired, hot water can be injected down the inner string, and removed via the annulus.

Produced water with melted paraffins is then pumped to the surface into e.g., a insulated settling tank to allow paraffin and oil to be skimmed off and is regularly treated with biocide. Excess produced water then spills over into holding tanks to be transported away, recycled or otherwise handled, and water from the bottom of the tank used in the next pump cycle, being pumped downhole again to melt paraffins in regular although intermittent manner. The water can be piped to a hot water heating tank where it is re-heated for repeated use, or the settling tank can include a heater or heat exchanger, or an inline heater can be used to bring the temperature back up to that level needed to melt paraffins.

Although skimming may be a preferred way to remove solids, it is not the only method, and other methods can be used including e.g., thermal, chemical or mechanical methods, solvents, dispersants, bacteria (e.g., *Pseudomonis, Ultramonis*), and the like.

It is not necessary, as a rule, to install a double tubing over the whole length of the tubing string, since, especially in the case of deep wells, owing to the high temperatures which prevail at greater depths, the fluidity of the oil is greater, so that it does not offer such great resistance as when it is more viscous and its higher temperature prevents deposits. However, the double string can also be installed so that the double tubing extends down to very near the downhole pump.

Preferably, the hot water is deoxygenated, according to known methods, in order to reduce corrosion. Alternatively (or in addition) corrosion inhibitors can be used. Furthermore, other chemicals can be added to the water, such as solvents to further mobilize wax deposits, chemicals to inhibit wax formation, surfactants and the like, as needed for the particular downhole conditions in each well.

At the beginning of each pump cycle heated water is pumped by a water transfer pump down the tubing annulus between the outer and inner tubes, thus heating the hollow rod string. Chemicals may be added to the heated water if desired. When the heated water enters the tubing at or near the pump inlet it melts and mobilizes paraffin that may have accumulated and solidified on the pump inlet or the vicinity, enabling paraffin to enter the pump and be pumped to surface. The pump is run until the well is pumped off and pump fillage drops below set point at which the POC (pump off control) shuts the pump off. This completes a single pump cycle.

As noted, the pump cycle is repeated at suitable intervals, such as daily, every other day, twice weekly, weekly or every other week, or monthly, depending on the severity of the paraffin deposition.

The above described methodology can be employed with a variety of pumping systems, including the hollow rod pumping systems, slim hole pumps, double string pumps, and slurry pumps.

The invention includes the following one or more embodiments, in any combination thereof:

A method of cleaning heavy material deposits including paraffin from a wellbore in an oil reservoir where a hollow rod pumping system is used in a wellbore that has heavy material deposits including paraffin. The hollow rod pumping system has an inner hollow rod having inlet ports at or below a pump fluidly connected to the hollow rod string, the inner hollow rod being inside an outer casing with an annulus being between the casing and the inner hollow rod. By pumping hot water at a first temperature outside of said hollow rod and out through said ports and into the annulus at the beginning of each pump cycle (or by pumping hot water in the reverse direction); the hot water is hot enough to melt the heavy material deposits producing hot water and melted heavy material. The hot water and melted heavy material are pumped up and out of the annulus (or out of the inner hollow rod) each pump cycle. The produced hot water and heavy material may be separated at a separation unit at the surface to remove the heavy material and leave remaining water. The water may be reheated and recycled to the hot water pumping. Oil or gas may be produced from the reservoir subsequent to and/or during each pump cycle. The pump cycle may be repeated at intervals throughput a production lifespan of the reservoir.

A method of cleaning paraffin from a wellbore in an oil reservoir; where a hollow rod pumping system is used in a wellbore that has paraffin deposits. The hollow rod pumping system has an inner hollow rod having ports at or below a pump fluidly connected. The inner hollow rod is inside an outer casing, with an annulus being between the casing and the inner hollow rod, pumping deoxygenated hot water at a first temperature down said annulus at the beginning of each pump cycle. The temperature being hot enough to melt the paraffin to produce hot water and melted paraffin. Pumping the hot water and melted paraffin up and out of said annulus and finishing said pump cycle and producing oil or gas from the reservoir. The steps may be repeated at every pump cycle throughout production from the reservoir. Produced hot water and melted paraffin are transferred to a settling unit where melted paraffin is removed leaving remaining water. The remaining water may be reheated and recycled in the hot water pumping step.

An apparatus for producing an oil or gas well, where a first tubing string extends in from the surface of said well to an oil producing zone in a reservoir, a second tubing string or casing of larger diameter surrounding said first tubing string in spaced relationship therewith and extending into said well to a depth below that of an area in which paraffin is deposited, said second string may be shorter than said first string. There is an annulus between the first tubing string and second tubing string or casing. A closure device below the pump on said first tubing string for closing the annular space between said first and second tubing strings, one or more fluid ports through the wall of said first tubing above said closure device, a pump at a lower end of said first tubing string, a string of sucker rods secured to said pump and extending to said surface within said first tubing string for reciprocating said pump, a hot water line for supplying to said annulus a clean deoxygenated hot water at a pressure sufficient to prevent the oil from rising within said first string to a level appreciably higher than that of said fluid port when said pump is operated, a recycle line fluidly connected to said well and said hot water line for removing water and melted paraffin from said first tubing string; the recycle line comprising a paraffin removal unit fluidly connected to a reheating unit.

The water may be deoxygenated before use. The wellbore may or may not be closed during pump cycle. Additionally, a slug volume of heated water is used at the start of each pump cycle. Heavy material deposits or paraffin may be removed by cooling and precipitation, by chemical reaction, and/or by skimming off the paraffin and heavy material. In one embodiment, melted paraffin is removed by skimming the melted paraffin off the surface of the remaining water. The wellbore may be closed for production during the heated pump cycle and re-opened for production. The pump cycle may be run every day, every 3-5 days, every week, every other week, or every month.

The reheating unit may use an indirect heat exchange unit to capture heat either from the returning hot water or from other processes. In one embodiment the indirect heat exchange unit using heat from produced hot oil to reheat water.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, buffers, salts, and the like.

The following abbreviations are used herein:

| ABBREVIATION | TERM |
|---|---|
| EUE | external-upset-end tubing |

DETAILED DESCRIPTION

The disclosure provides a novel method of removing paraffins and other heavy materials that would otherwise eventually block flow in a wellbore.

The present invention is exemplified with respect to cleaning a well of paraffins. However, this is exemplary only, and the invention can be broadly applied to any meltable solid that can be removed with a hot water wash such as described herein. Furthermore, although we have described a hot water wash, wax solvents, crystallization inhibitors, surfactants, and other additives can of course be added to the wash medium to further assist in deposit removal. The descriptions herein are intended to be illustrative only, and not unduly limit the scope of the appended claims.

Hollow Rod Pumping System

Figure 1:
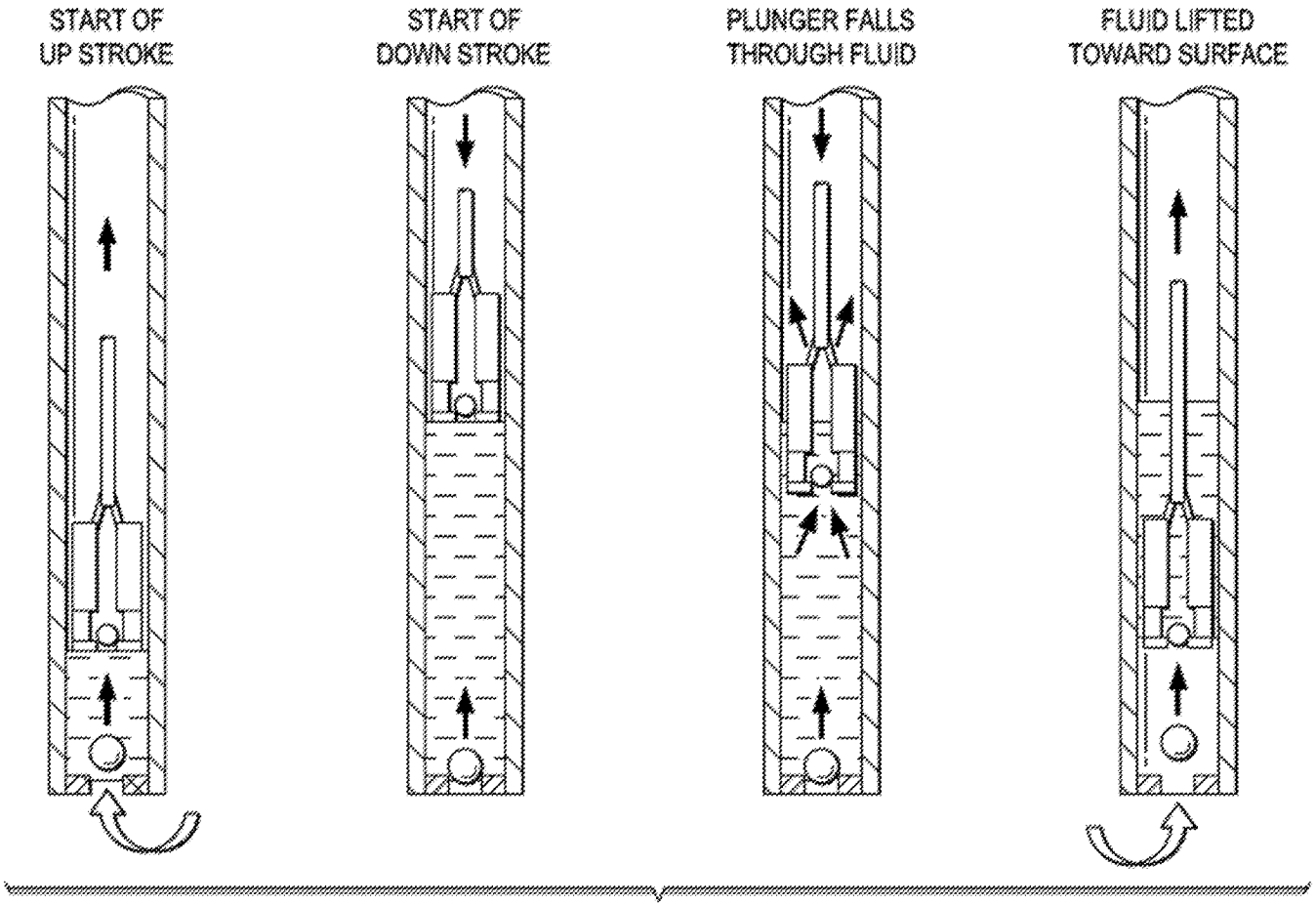
FIG. 1 illustrates the mode of action of a hollow rod pumping system with ball valves.

FIG. 1 illustrates the mode of action of a downhole sucker rod pump with a standing (lower) valve, and a travelling (upper) valve.

Figure 2:
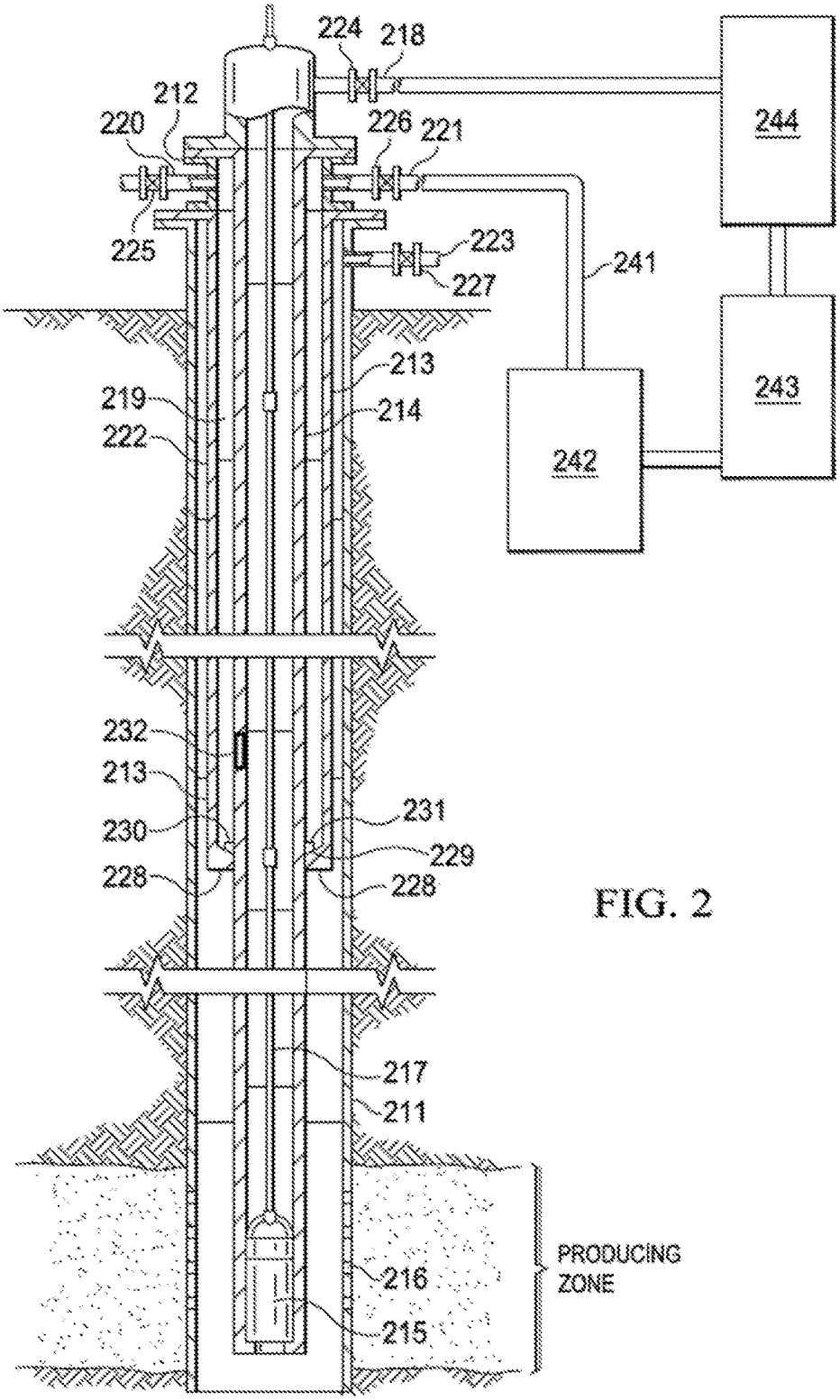
FIG. 2 shows a hollow rod pumping and recycle system for use downhole that is designed for usage in oil production industry to deliver a medium to the well for cleanout purposes.

FIG. 2 shows a hollow rod pumping and recycle system for use downhole that is designed for usage in oil production industry to deliver a medium (herein hot water) to the well for cleanout purposes.

A well borehole is shown lined with a string of casing 211 that is closed at the top by a conventional casing head 212. Below the casing head 212 within the casing 211 are two concentric strings of tubing—the outer tubing string 213 and the inner tubing string 214. The inner tubing 214 normally extends to the bottom of the well or to a point substantially adjacent the payzone.

A conventional plunger pump 215 is anchored in the inner tubing 214 in a manner well known to the art, said pump 215 being preferably anchored at or below the level of the payzone. At this point, the inside of the casing 211 is in communication with the space outside thereof (annulus) through a series of perforations 216 in said casing. The pump is actuated by a string of sucker rods 217 extending up through the inner tubing 214 and passing in a fluid tight manner through the casing head 212, where said sucker rod string is reciprocated by suitable prime mover (not shown) located at the surface.

At the surface the casing head 212 is provided with suitable conduit and/or valving for introducing or discharging fluids from the well. Thus, the inner tubing string is provided with conduit 218, the annular space 219 between the outer and inner tubing 213 and 214 is equipped with conduits 220 and 221, and the annular space 222 between the casing 211 and the outer tubing 213 may be provided with a one or more conduits 223. The flow of fluids through conduits 218, 220, 221 and 223 is controlled by valves 224, 225, 226 and 227, which can be any suitable valve or pipe closure device.

The length of the outer tubing string 213 may vary and depends upon such well characteristics as well depth, well temperature, composition of the oil being pumped, paraffin content of the oil, etc. In general, the outer tubing 213 extends from the casing head 212 down to the lowest point in the well at which paraffin is known to accumulate on the inner surface of the inner tubing string 214.

A seal is formed between the bottom of the outer tubing 213 and the outer wall of the inner tubing 214 in any suitable manner well known to the art. For example, a conventional packer can be employed or an annular plate may be welded in place. In the latter case it would be necessary to insert or pull both strings of tubing 213 and 214 from the well together.

To obviate the necessity of pulling the outer tubing 213 when a pump is being replaced, the lower end of the outer tubing 213, a shoe 228 may be used having an internal seating face 230 of an annular ring 231 carried on the outer surface of the inner tubing 214. When the seating faces 229 and 230 are in engagement a fluid tight seal is formed between the lower end of the outer tubing 213 and the outer wall of the inner tubing 214. Other sealing methods are available and may be used.

The inner tubing string 214 is provided with fluid ports or perforations 232 in communication between the bore of the inner tubing and the annular space 219 between the tubing 213 and 214 above the ring 231. In operation, the inner tubing 214 may be filled with a gas or a stagnant liquid, said fluid being introduced through conduit 218. Thus, a considerable length of the reciprocating sucker rods 217, which actuate the pump 215, move in the inner tubing 214 filled with gas or stagnant liquid so that they encounter considerably less resistance than if they had to move in the oil being pumped, especially viscous oil.

In the production phase, oil from the formation flows into the casing 211 through perforations 216 and then into the pump 215. The reciprocating pump 215 lifts the fluid up the inner tubing 214 until it reaches the slots 232 and into the annular space 219 between the inner and outer tubing 214 and 213. Fluid is lifted therein to the head of the well where it is discharged through conduit 220 or 221, as desired, typically to a tank (not shown) where oil and produced water can be separated and further treated as needed (not shown).

Since the outer tubing 213 extends below the point at which paraffin deposits are formed, no paraffin becomes deposited on the inner surface of the inner tubing 214 or on the sucker rods 217. Below the perforations 232, the temperature of the oil is usually sufficiently high to prevent depositions of paraffin, while above the perforations the gas or stagnant liquid prevents deposition by preventing the rise of oil to any considerable height above said perforations. As a result, less energy is required by the prime mover to reciprocate the pump and, hence, the rate of pumping may be increased.

In addition, the arrangement according to this invention has the advantage that, when the tubing string has to be cleaned, hot water can be injected into the inner tubing 214, to emerge again through the annular space between inner and outer tubing 219, thus freeing this annular space from paraffin. This treatment can therefore be carried out without having to pull the system of pump and rods to the surface. The path of the heated water can also be reversed, whereby the hot water is delivered through the inner tubing 214. In one embodiment, the pump cycles in reverse directions each time, thus alternately cleaning the tubing/tubing annulus and inside the inner tubing.

It is not usually necessary to install a double tubing over the whole length of the tubing string, since, especially in the case of deep wells, owing to the high temperatures at greater depths, where the fluidity of the oil is greater. Nor will paraffin be deposited at elevated temperature as long as this temperature lies above the setting point (wax appearance temperature). Consequently, the double tubing need only be installed to a depth at which the temperature is such as to cause deposition problems.

The double tubing arrangement is also suitable for the injection of chemicals, which are very often applied to prevent formation of emulsion and paraffin deposits, in the same way as described above with reference to a cleansing medium. In such case, it may be preferred that the double tubing extends down to very near the pump.

When hot water is to be circulated for cleaning the tubing strings 213 and 214, the hot liquid may be injected through conduit 218. Of course, seals 229/230 are engaged during hot water cleaning, thus preventing production fluid flow.

The hot water cleaning liquid is passed down the inner tubing 214, through slots 232, and up the tubing/tubing annular space 219 to be discharged at the well head through conduit 221 to the recycle line, 241 through one or more treatment tanks, such as settling tank 242 in which floating paraffin is removed, to a deoxygenation unit 243 and reheating unit 244 and then recycled into input line 218. The placement and ordering of deoxygenation unit 243 and reheating unit 244 can vary, but are shown herein as being part of the input conduit 218. Additionally, one or more of these units can be combined. Further, the direction of fluid flow can vary, e.g., go in the annular space, and out the inner tubing through conduit 218, and the recycle line adjusted according.

In practice, the hot water line is run at intervals or continuously through the producing lifespan of the well, e.g., daily, every other day, weekly, and the like, as needed for the degree of paraffin deposition in a given well. Once the hot water and melted paraffin have been removed from the system, the well can be opened again for production. This is referred to herein as "a continual intermittent cleaning cycle," meaning that it occurs at regular time points or continuously, even though it is probably not running all of the time.

Double String Pump

Figure 3:
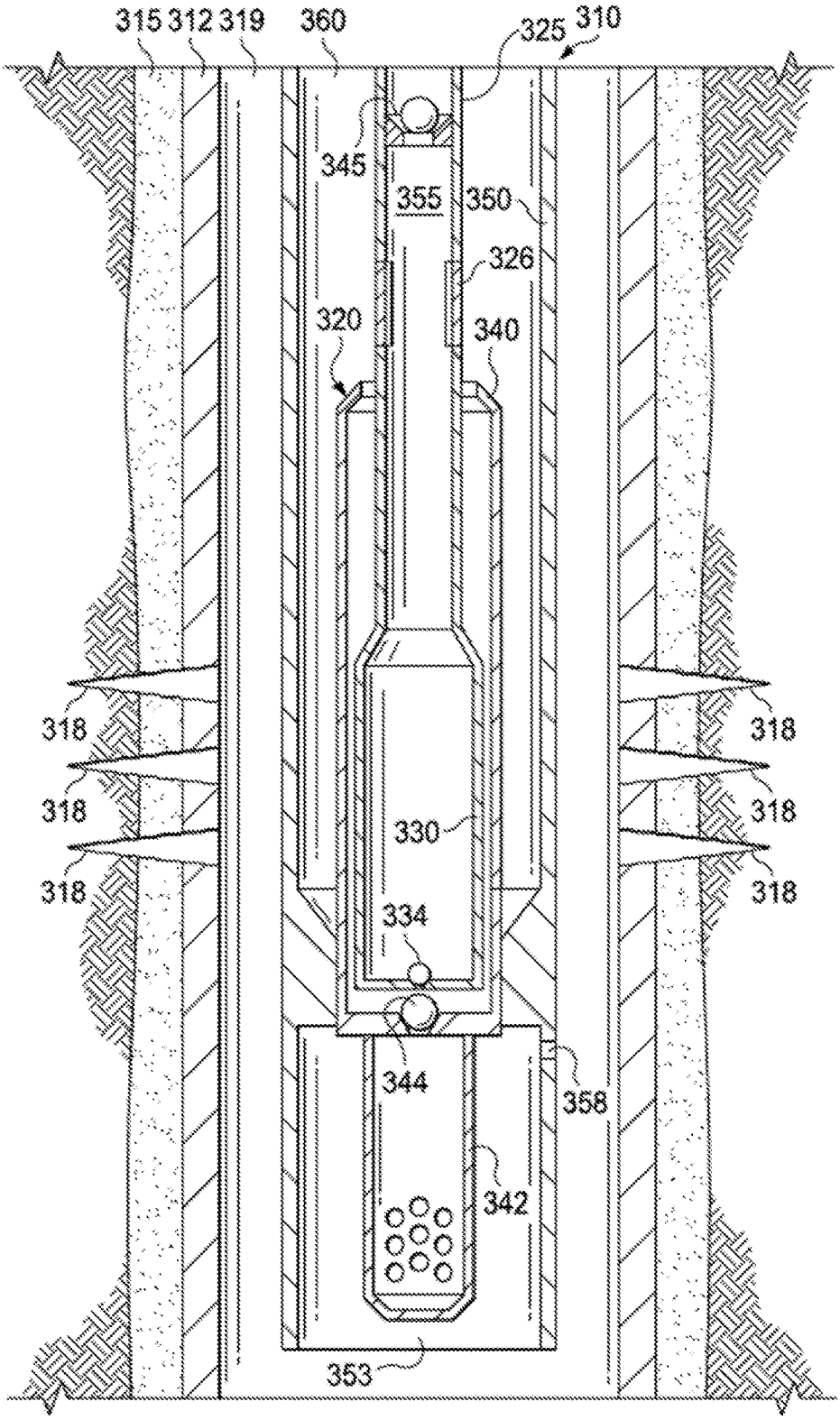
FIG. 3. detailed diagram of a double string pump system.

FIG. 3 shows a double string pumping system. The inside of the casing 312 is in communication with the space outside thereof through a series of perforations 318 in said casing 312 that extend through the casing cement 315 into the pay zone. Plunger 330 is moved up and down inside the barrel 340 by a hollow valve rod 325 which attaches to the hollow rod string. The hollow rod valve 325 is similar to a sucker rod, but has additional functions and features. The plunger 330 is arranged to convey the liquid up the hollow rod string 325 where the inner diameter of the hollow rod string 322 is much smaller than the production path of a typical pump. Thus, each stroke of the plunger 330 may move the same volume of liquid, but the liquid moves far closer to the surface at a higher velocity so that the entrained solids are more likely to be carried farther up the production path 355 within the hollow rod string 325 during each pump operation cycle.

Check valves, such as shown at 345, are provided within the production path 355 so that when a pumping cycle is ended and the pump 320 is idled, the particles only settle down to the last check valve each particle may have passed. If present, check valves or ball checks 345 may be spaced within the string so that the volume between them does not exceed the volume expected to be pumped during each a pumping cycle so that particles pass through at least one check valve during each pump cycle. Also, with the smaller diameter in the production path 355, the pump rate should equal or exceed the lift velocity required for the well and re-entrainment of the solids into the liquid flow should be quicker and more certain.

In one aspect of the invention, hollow rod string 325 is connected to plunger 330 by a hollow shear tool 326. The hollow shear tool 326 provides a well operator with a predetermined "weakest link" for the production system in the event that the pump 320 is stuck in the wellbore 310. In that circumstance, the well operator will know that lifting on the hollow rod string 325 with a tension above the shear strength of the hollow shear tool 326 will cause the hollow shear tool to separate near the pump 320 allowing the pump and rod string to be removed from the well.

The remaining portion of the hollow shear tool 326 is suitable for wireline or other high strength fishing tools to get the pump 320 out of the wellbore. If fishing is not effective, the production tubing may be withdrawn without the complication of also disconnecting the segments of hollow rod string that are inside the segments of production tubing. An operator of a wellbore will prefer a system that is predictable in its failure mode and fails in a manner that minimizes delays to returning to operation.

A second aspect of the embodiment in FIG. 3 is that there is now a tubing annulus 360 that is inside the production tubing 350, and outside the rod string 325. This tubing annulus 360 is filled with production liquid that has been carried to the surface and filtered or otherwise treated. Thus, the plunger 330 has clean liquid around the outside thereof and to the extent that any filtered liquid might pass along the small gap around the outside of the plunger 330 and within the barrel 340, it would tend to sweep any particles in that gap back into a location where such particles are directed up into production path 355.

Ideally, the level of filtered liquid between the hollow rod and tubing would extend to the surface so that the pressure head on the inside and outside of the plunger is the same or very close to the same. At the end of the pump operation cycle, it is preferred that the plunger 330 is in the "up" position so that if gas had entered the space below the bottom of plunger 330 and above standing valve 344 that some amount of filtered liquid in the barrel 340 would pass through the small gap between the plunger and the barrel during the idle time and occupy enough space to unseat the traveling valve 334 before the plunger reaches it full bottom stroke. As long as the travelling valve 334 can be unseated, the gas will quickly pass into the plunger and the gas lock condition will be alleviated without having to undertake substantial intervention. In an alternative embodiment, double standing and double travelling valves may be preferred where fluid travels through a first of the double valves and then through the second. A double valve arrangement provides redundancy in the event that solid particles block open one of the valves.

While abrasion and wear may be the primary concern, another aspect that may help avoid gas locks is to provide a vent 358 to allow any gas that has entered the quiet zone 353 such as gases dissolved from the hydrocarbon liquid to pass back into the annulus 319 and exit the well 310. The vent 358 is above the highest opening in the strainer nipple 342 so that the liquid level inside the quiet zone 353 is not lower than the liquid level outside the quiet zone in the annulus 319. Another strategy to alleviate gas lock is to increase the fluid slippage past the plunger/barrel interface from annulus 360 into barrel 340 to displace traveling valve 334 and push gas into flow path 355.

Recycle System

Figure 4:
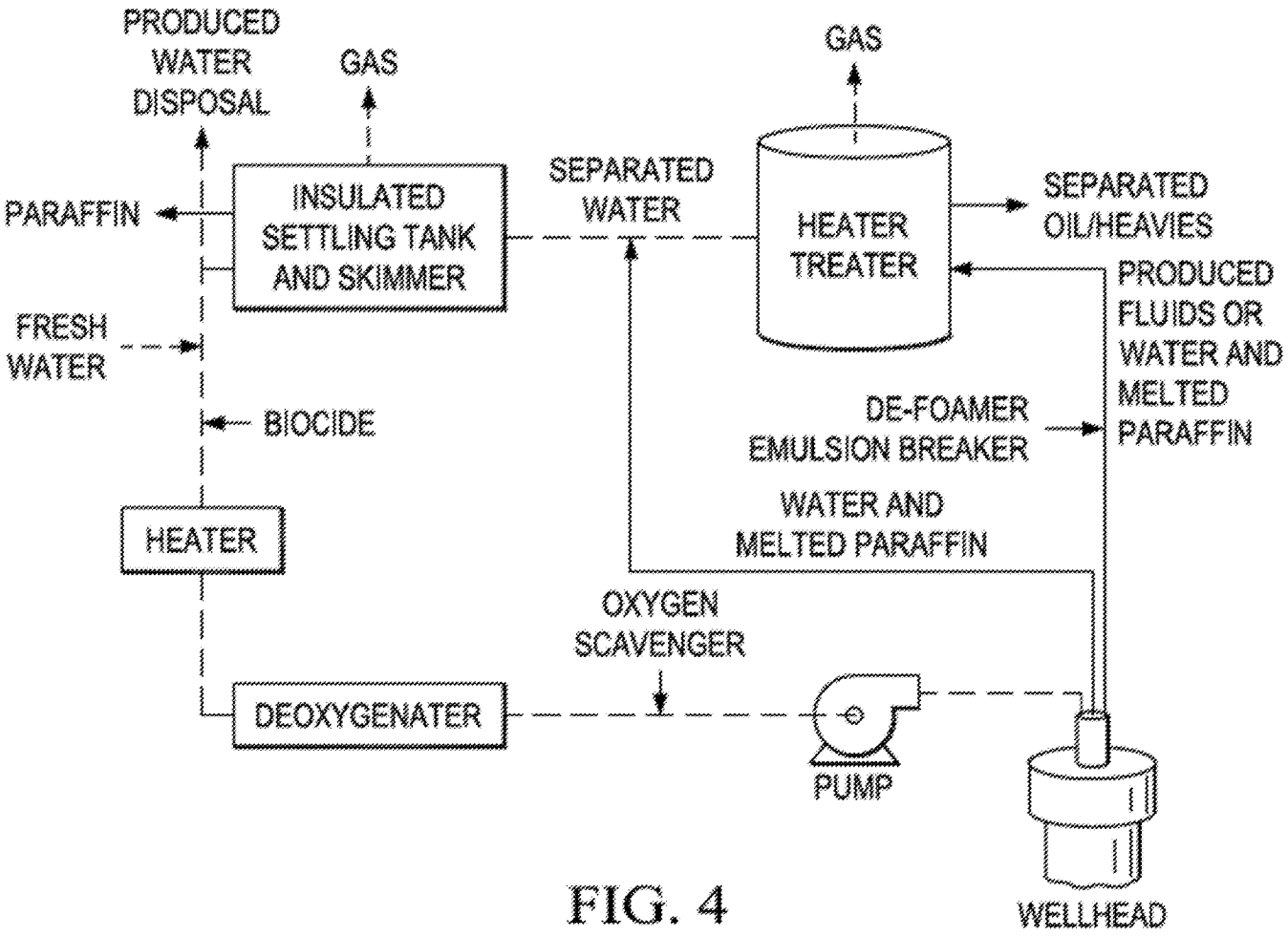
FIG. 4. Recycle system for the removal of paraffin from a well.

The hot water used in the cleaning operation is returned and recycled and one example of a recycle pathway is shown in FIG. 4. Any melted wax will typically float, and can be skimmed from the surface, and the remaining water continuing through treatment and recycle. As one example, a heater/treater is used to separate produced water and oil/paraffins. The oil/paraffins are sent for further treatment and/or sale, or used on site for energy production, as needed. The produced water is typically reused, in this system it is kept warm in an insulated tank, and used again for hot water paraffin cleaning. It may be preferred to recycle water for downhole use from the bottom of the insulated settling tank, to avoid sending paraffins or oil downhole for the hot water flush cycle. An overflow circuit can accept any spillover and route it accordingly.

A heater is added to further heat the water before reuse downhole, and in preferred embodiments, this is a heat exchange unit of some kind, capturing otherwise waste heat. Another option is to use the skimmed paraffins/oil to generate heat in a furnace and use that heat to further heat the water to the extent needed before reuse downhole.

Demulsifiers and biocides will prevent growth in the water and can be added at any point in the recycle line. Also, in the recycle pathway, a unit to remove oxygen is included, and/or oxygen scavengers added to prevent corrosion. It may be important to keep the system oxygen free and sealed to prevent corrosion, as corrosion of the sucker rods and other metals equipment can be very detrimental. A fresh water line can add water to the system as needed.

Demonstration

A conventional downhole pump was replaced with the hollow rod pump with 1 inch hollow rod inside a 2⅜ inch outer diameter EUE tubing (4.7 nominal weight lbs/ft). Two barrels of water heated to 180° F. were run down the annulus, between the tubing and the hollow rod. This amount of water is equal to a two thousand foot column of water falling down the annulus.

The hot water heated the inner string, thus beginning to melt the paraffin deposits. Additional melting occurred when the hot water enters the ports to the pump below the hollow rod, thus further melting any deposits contained therein, as well as any stuck in valves or on the pumping equipment itself. The hot water plus melted heavies were then pumped out of the well via the hollow rods. The pump rod pump cycle is then complete and the well is then configured for production, which then commences.

As another option, the produced water can be sent to a heater treater, which normally functions to separate oil and water, and it will also separate water and paraffin melt. Such an option may be beneficial and the heater/treater will heat the water, allowing one to avoid adding a heater downstream. This is shown in FIG. 4.

This method was repeated at suitable intervals, such as daily, weekly, or otherwise, depending on downhole temperatures and level of heavies in the reservoir. Colder temperatures, reduced pressure and increasing amounts of paraffin in the crude will all serve to decrease the interval time.

The following references are incorporated by reference in their entirety for all purposes.

U.S. Pat. No. 1,358,393 Apparatus for removing paraffin from oil-wells

U.S. Pat. No. 2,704,979 Control of paraffin deposition

U.S. Pat. No. 4,813,482 Method for removal of paraffin from producing oil wells

Haitao, et al., "Thermal wax cleaning technology of the hollow rod without cutting production," Oil Drilling & Production Technology 35 (4): 117 (2013).

What is claimed is:

1. A method of cleaning heavy material deposits from a wellbore tubing in a hydrocarbon reservoir, said method comprising:

a) providing a hollow rod pumping system to a wellbore tubing in a reservoir that has heavy material deposits, said heavy material including paraffin;

i) said hollow rod pumping system comprising an inner hollow rod having fluid inlet ports and a pump fluidly connected thereto, ii) said inner hollow rod being inside an outer casing, an annulus being between said casing and said inner hollow rod, and iii) said inner hollow rod having a tubing with an annulus and one or more ports around said inner hollow rod, b) pumping hot water at a first temperature through the annulus between the tubing and hollow rod at a beginning of a pump cycle;

i) said first temperature being hot enough to melt said heavy material deposits to produce hot water and melted heavy material;

c) pumping said hot water and melted heavy material up and out of said annulus thereby completing the pump cycle;

d) sending produced hot water and heavy material to a unit at a surface to remove said melted heavy material and leave remaining water;

e) reheating said remaining water;

f) recycling said reheating water in said hot water pumping step b;

g) producing oil or gas from said reservoir subsequent to each pump cycle; and h) repeating said pump cycle at regular intervals throughput a production lifespan of said reservoir, wherein a slug of heated water is used at the start of each pump cycle.

2. The method of claim 1, wherein said water is deoxygenated before use in step b.

3. The method of claim 1, wherein said wellbore tubing is closed for production during pump cycle b through c and re-opened for production in step g.

4. The method of claim 1, wherein heavy material is removed in step d by cooling and precipitation.

5. The method of claim 1, wherein heavy material is removed in step d by chemical reaction.

6. The method of claim 1, wherein heavy material is removed in step d by skimming off said heavy material.

7. An apparatus for producing oil or gas from an oil well, comprising:

a) a first or inner tubing string extending in a well from a surface of said well to an oil producing zone in a reservoir;

b) a second tubing string of larger diameter surrounding said first tubing string in spaced relationship therewith and extending into said well to a depth below that of an area in which paraffin is deposited, said second string being shorter than said first string;

c) an annulus being between said first and second tubing strings;

d) a closure device within the lower end of said second tubing string for closing the annular space between said first and second tubing strings;

e) one or more fluid ports through the wall of said first tubing above said closure device, f) a pump at a lower end of said first or inner tubing string;

g) a string of sucker rods secured to said pump and extending to said surface within said first tubing string for reciprocating said pump;

h) a hot water line for supplying to said annulus a clean deoxygenated hot water for melting paraffin;

i) a recycle line fluidly connected to said well and said hot water line for removing water and melted paraffin from said first tubing string; and j) said recycle line comprising a paraffin removal unit fluidly connected to a reheating unit.

8. The apparatus of claim 7, said recycle line further comprising a deoxygenating unit.

9. The apparatus of claim 7, said reheating unit comprising an indirect heat exchange unit.

10. The apparatus of claim 9, said indirect heat exchange unit using heat from produced hot oil to reheat water.

11. The apparatus of claim 7, said recycle line further comprising a deoxygenating unit connected to an indirect heat exchange unit.

12. The apparatus of claim 7, said recycle line further comprising a deoxygenating unit connected to an indirect heat exchange unit using waste heat from produced hot oil to reheat water.

* * * * *